United States Patent [19]

Hayashi

[11] 4,298,550

[45] Nov. 3, 1981

[54] CARBURETOR

[75] Inventor: Kenji Hayashi, Aichi, Japan

[73] Assignee: Aisan Industry Co., Ltd., Aichi, Japan

[21] Appl. No.: 114,794

[22] Filed: Jan. 24, 1980

[30] Foreign Application Priority Data

Jan. 29, 1979 [JP] Japan ..... 54/9568

[51] Int. Cl.[3] ..... F02M 7/20

[52] U.S. Cl. ..... 261/69 R; 261/39 R

[58] Field of Search ..... 261/69 R, 39 R

[56] References Cited

U.S. PATENT DOCUMENTS

| | | | |
|---|---|---|---|
| 1,858,835 | 5/1932 | Mabee et al. | 261/69 R |
| 1,909,389 | 5/1933 | Ball et al. | 261/69 R |
| 2,415,491 | 2/1947 | Hieger | 261/69 R |
| 2,580,294 | 12/1951 | Griffon | 261/69 R |
| 3,037,751 | 6/1962 | Phillips | 261/69 A |
| 3,437,081 | 4/1969 | Mennesson | 261/69 R |
| 3,677,526 | 7/1972 | Pierlot | 261/69 R |
| 3,706,444 | 12/1972 | Masaki et al. | 261/69 R |
| 3,807,172 | 4/1974 | Masaki | 261/69 R |
| 3,960,990 | 6/1976 | Bishop et al. | 261/69 R |
| 4,051,824 | 10/1977 | Sugiura | 261/69R |

FOREIGN PATENT DOCUMENTS

| | | | |
|---|---|---|---|
| 52-11339 | 1/1977 | Japan | 261/69 R |
| 305338 | 2/1929 | United Kingdom | 261/69 R |

*Primary Examiner*—Tim R. Miles

[57] ABSTRACT

A carburetor for supplying the mixture of optimum air-fuel ratio to the engine at all times under any accelerating condition. The carburetor comprises a fuel adding valve and associated valve mechanism whereby when the vacuum pressure in the suction pipe decreases as a result of acceleration, the fuel adding valve is opened to deliver extra fuel in addition to the main fuel to produce the mixture of optimum richness. With this invention, the conventional drawback can be precluded that after the first stage of acceleration the mixture becomes leaner than is required.

16 Claims, 5 Drawing Figures

CARBURETOR

BACKGROUND OF THE INVENTION

This invention relates to a carburetor which can adjust the richness of the mixture to be supplied to the engine at an optimum air-fuel ratio during acceleration.

In improving the driver's comfort and reducing the noxious gas emission from the internal combustion engine of automobiles, it is very important to supply a fuel mixture of optimum air-fuel ratio under any driving condition.

Conventional carburetors employ an acceleration device for correcting the air-fuel ratio at a time of acceleration. However, the conventional device cannot meet the recent higher standards for noxious gas emission.

FIG. 1 shows the conventional carburetor with an acceleration device. Fuel is contained in an acceleration fuel reservoir 2 as well as in a fuel chamber 1. When a driver depresses an accelerator pedal to accelerate the engine, an acceleration lever 5 is rotated about the fulcrum 6 by the link 4 connected with the throttle valve 3 and pushes the piston 7 downwardly with the result that the fuel in the acceleration fuel reservoir 2 is delivered through the passage 8 and ejected from the nozzle 9 into the mixture. Ball valves 10 and 11 are provided at the inlet and outlet of the acceleration fuel reservoir 2 and which serve to prevent the fuel backflow. A venturi 12, a nozzle 13, and a float 14 are included. With this kind of acceleration device it is impossible to provide the mixture of optimum richness at all times under various accelerating conditions. Namely, in this conventional carburetor, the mixture is rendered rich momentarily only in the period in which the piston 7 is depressed as a result of a depression of the accelerator pedal, and the initial condition recovers soon to render the mixture unnecessarily lean. Thus, the conventional carburetor needs to be improved for better acceleration and reduced noxious emission from the engine.

SUMMARY OF THE INVENTION

An object of this invention is to provide a carburetor, which, over a desired length of time, can keep the air-fuel ratio of the mixture at an optimum value during acceleration by providing additional fuel required for acceleration.

To achieve this objective, a carburetor of this invention comprises a fuel adding passage; a fuel adding valve disposed in the fuel adding passage to open and close the passage; and a valve mechanism which, when the negative pressure in the suction pipe changes as a result of acceleration, introduces atmospheric pressure to a negative pressure passage to open the fuel adding valve thereby controlling the air-fuel ratio of the mixture at an optimum value under any accelerating condition.

DESCRIPTION OF THE PREFERRED EMBODIMENTS

The present invention will now be described with reference to the accompanying drawings showing preferred embodiments.

Figure 1:
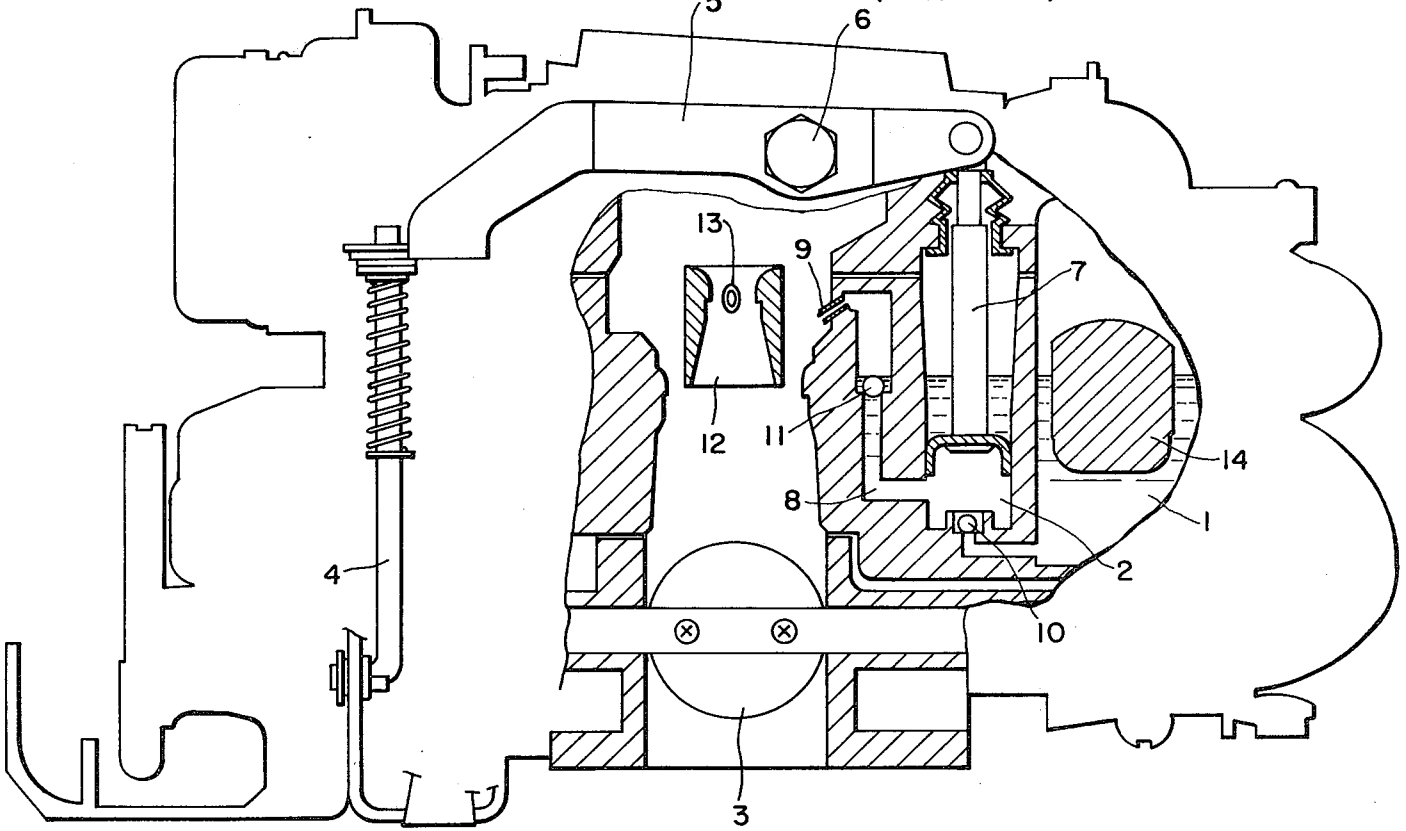
FIG. 1 (PRIOR ART)
FIG. 1 is a cross-sectional view of a conventional carburetor.
Figure 2:
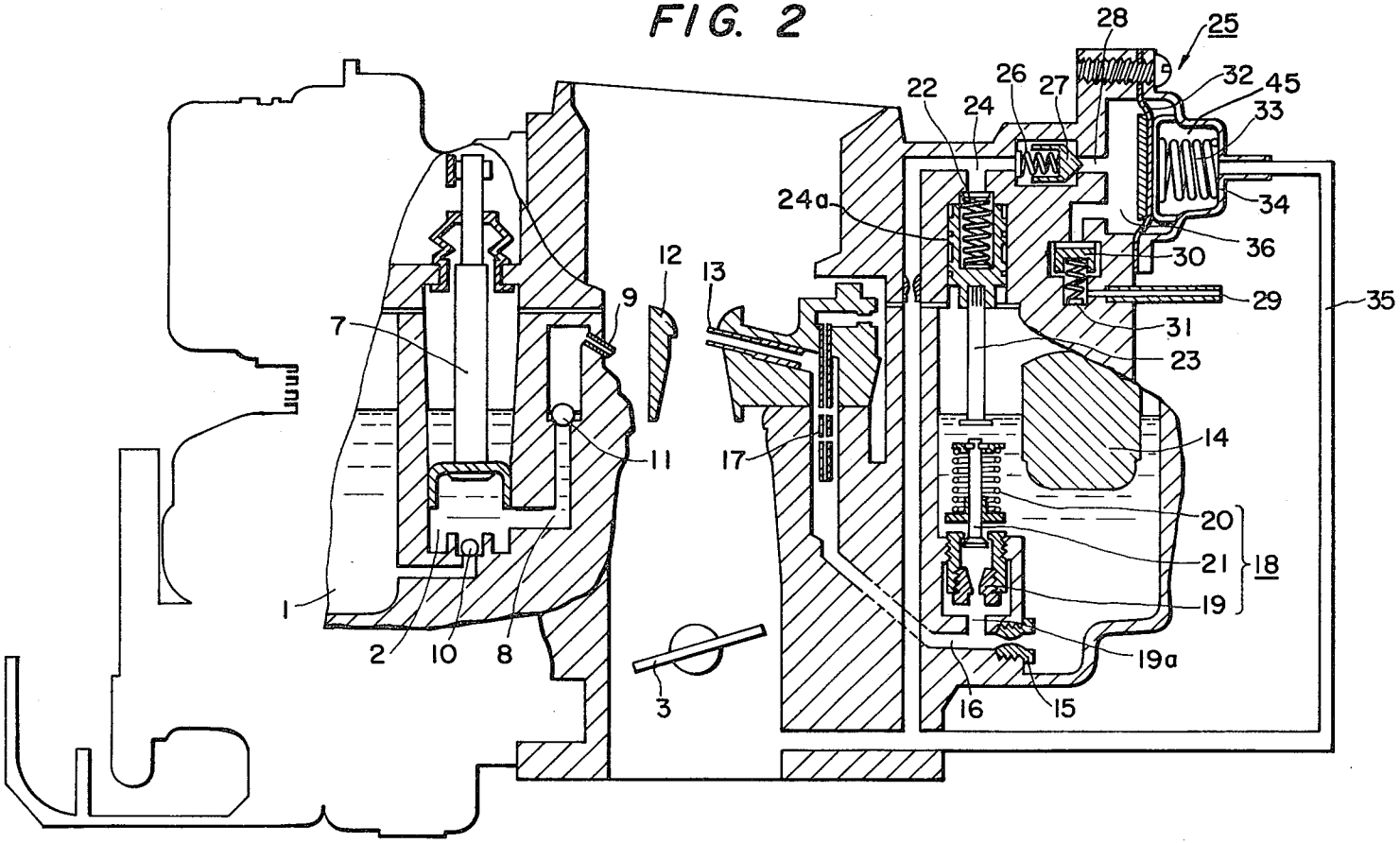
FIG. 2 is a cross-sectional view of one embodiment of a carburetor according to this invention.

Referring now to FIG. 2 a carburetor has a fuel chamber 1, a fuel main jet 15, a main fuel passage 16, and an air bleed 17. A fuel adding valve 18 used to supply fuel to the main fuel passage 16 during acceleration comprises an auxiliary jet 19 and a valve 21 biased by a spring 20, and is actuated by the change in the negative pressure in the suction pipe. A piston 23 is sidably disposed in a piston chamber **24*a* connected to a negative pressure passage 24 and is urged downward by a spring 22. When the vacuum in the negative pressure passage 24 increases, the piston 23 is lifted up against the spring 22 to allow the valve 21 to move upward by the action of the spring 20 thereby shutting off the fuel adding passage 19*a* and blocking the supply of additional fuel through the auxiliary jet 19. When the vacuum decreases below a predetermined negative pressure, the piston 23 moves downward by the spring 22 and pushes down the valve 21 against the force of the spring 20 to open the fuel adding passage. The negative pressure passage 24 for actuating the fuel adding valve 18 is connected to a diaphragm means 25. To state more specifically, the negative pressure passage 24 is connected by a passage 28 to a chamber 36 with a valve 27 disposed in the passage 28 and biased by a spring 26 to close the passage. A chamber 36 of the diaphragm means 25 is provided with a passage 29 for introducing the atmospheric pressure and with a valve 30 which is disposed in the passage 29 and biased by a spring 31 to open the passage. The diaphragm means 25 consists of a diaphragm 32, a spring 33 and a case 34, and forms another chamber 45 of the diaphragm means which communicates with a negative suction pressure introducing passage 35 which opens into the suction pipe downstream of a throttle valve 3. Components of this embodiment having the same reference numerals as those shown in FIG. 1** are identical in construction with the latter; hence their explanations are omitted here.

We will now explain the action of this device.

When the engine is idling or running at a constant speed, the components of this carburetor assume their positions as shown in FIG. 2. In this condition, the throttle opening degree is small and the vacuum level in the negative pressure passage 24 is high so that the piston 23 is lifted upward compressing the spring 22. As a result, the valve 21 moves up by the action of the spring 20, closing the fuel adding valve 18. Thus, the supply of fuel to the engine is only through the main fuel jet 15. Because of the high vacuum level the diaphragm 32 of the diaphragm means 25 compresses the spring 33 as shown in FIG. 2. The valve 27 opens or closes depending on the pressure difference between the negative pressure in the passage 24 and the atmospheric pressure in the chamber 36. The valve 30 is pushed up by the spring 31 to let the atmospheric pressure enter the chamber 36. The force of the spring 31 is set large enough not to be affected by the negative pressure in the passage 29.

Figure 3:
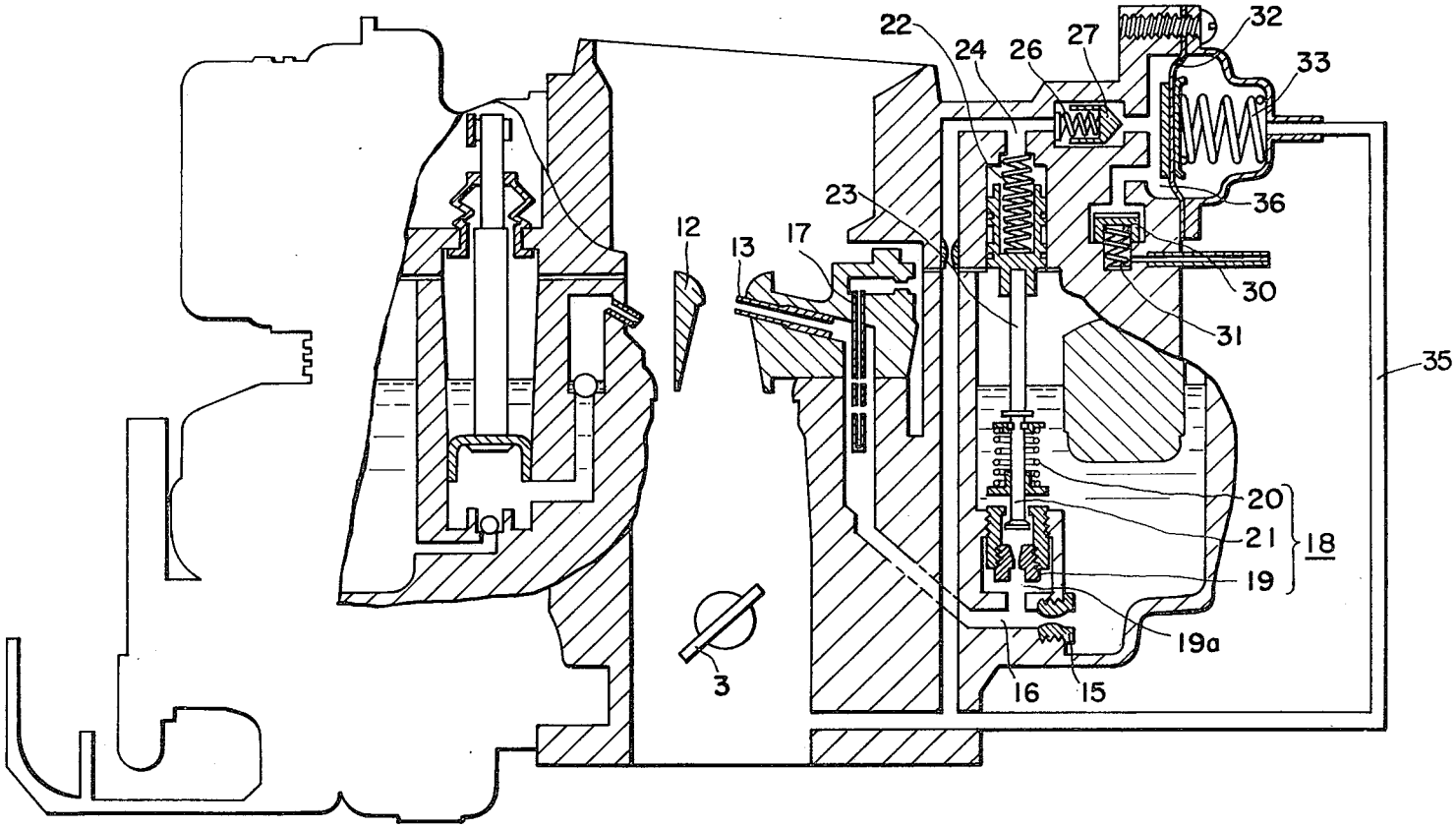
FIGS. 3 and 4 are cross-sectional views of the carburetor of this invention in operation.
Figure 4:
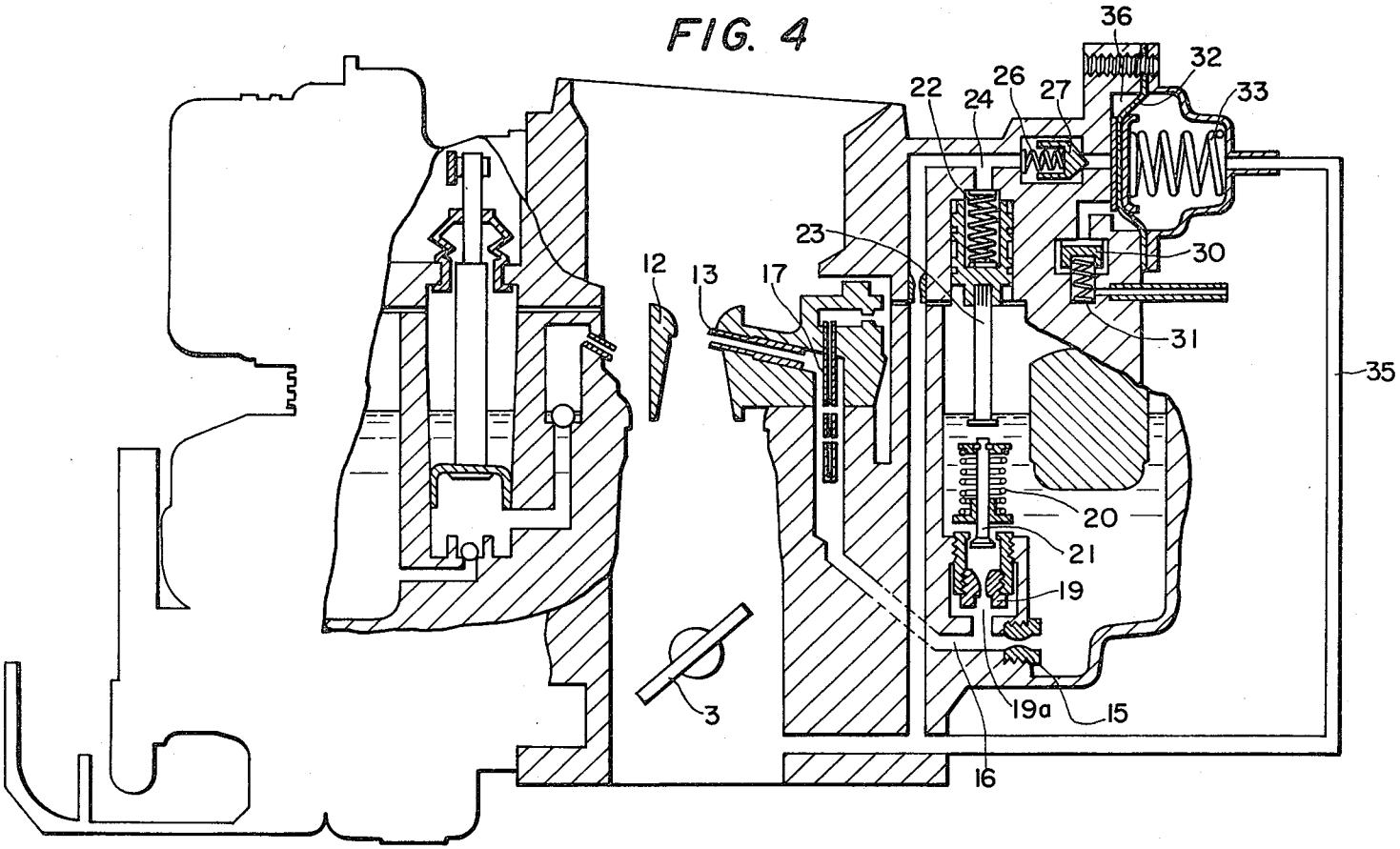

In this condition, when the engine is accelerated, the throttle valve 3 is opened to reduce the vacuum level in the suction pipe. This is shown in FIG. 3. As the negative pressure decreases, the diaphragm 32 is displaced toward the left by the spring 33 to push the air out of the chamber 36 with the result that the valve 30 is pushed down compressing the spring 31 and closing the passage 29 and the valve 27 compresses the spring 26 to allow the air in the chamber 36 to flow into the passage 24. As the air comes into the passage 24, the negative pressure acting upon the piston 23 decreases to a level near the atmospheric pressure. As a result, the piston 23 is pushed downwardly by the spring 22 to open the valve 21 and thereby let the additional fuel flow into the main fuel passage 16 from the fuel adding passage so as to adjust the air-fuel ratio of the mixture to an optimum value. Shortly afterwards, the negative pressure is restored in the passage 24 so that the piston 23 moves up closing the valve 21 and stopping the extra fuel flow through the fuel adding valve 18, as shown in FIG. 4. Thus, the rate of supply of fuel is increased over a certain length of time which is determined by factors such as the volume of the chamber 36.

Figure 5:
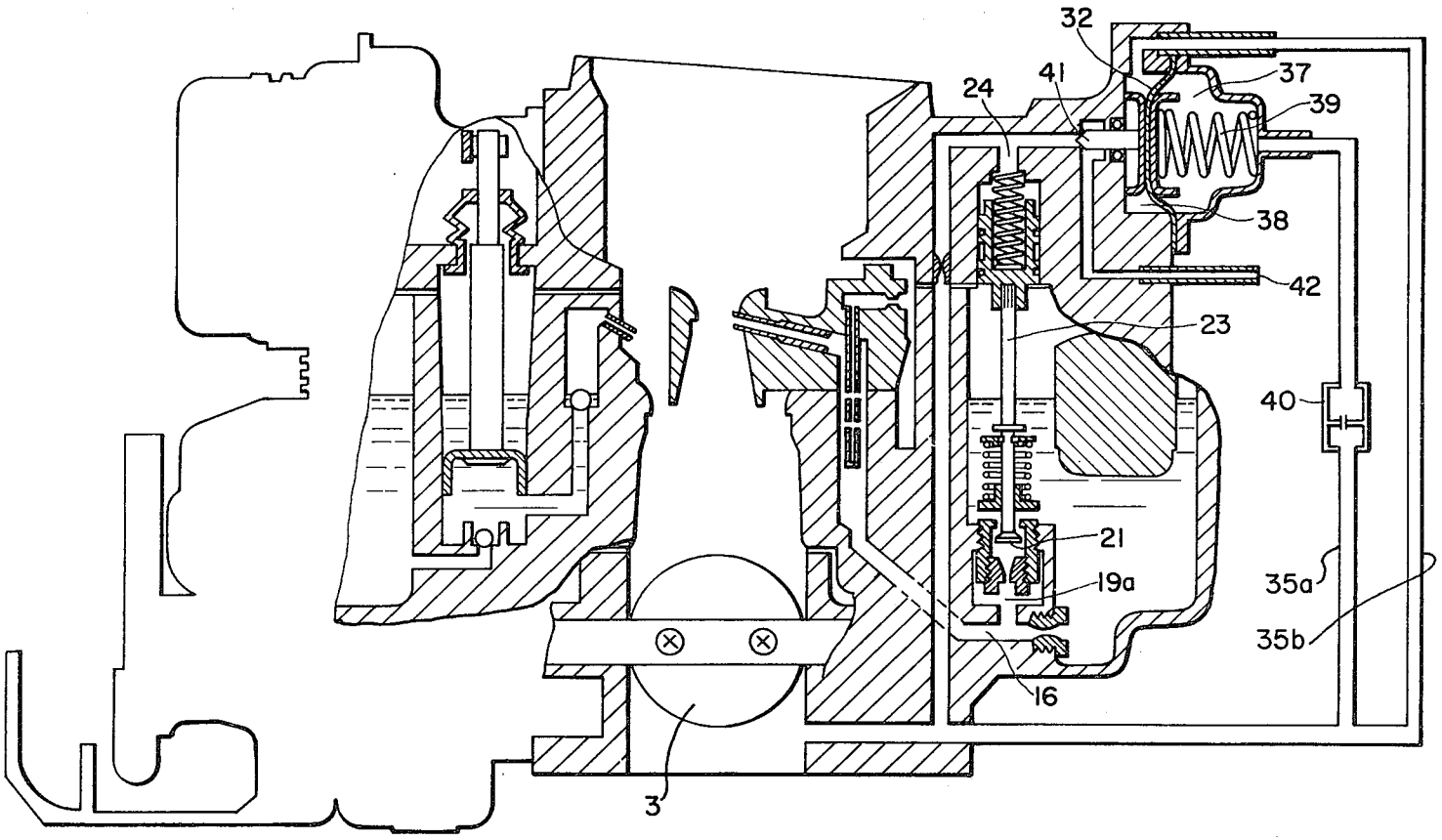
FIG. 5 is a cross-sectional view of another embodiment of this invention.
Figure 1:
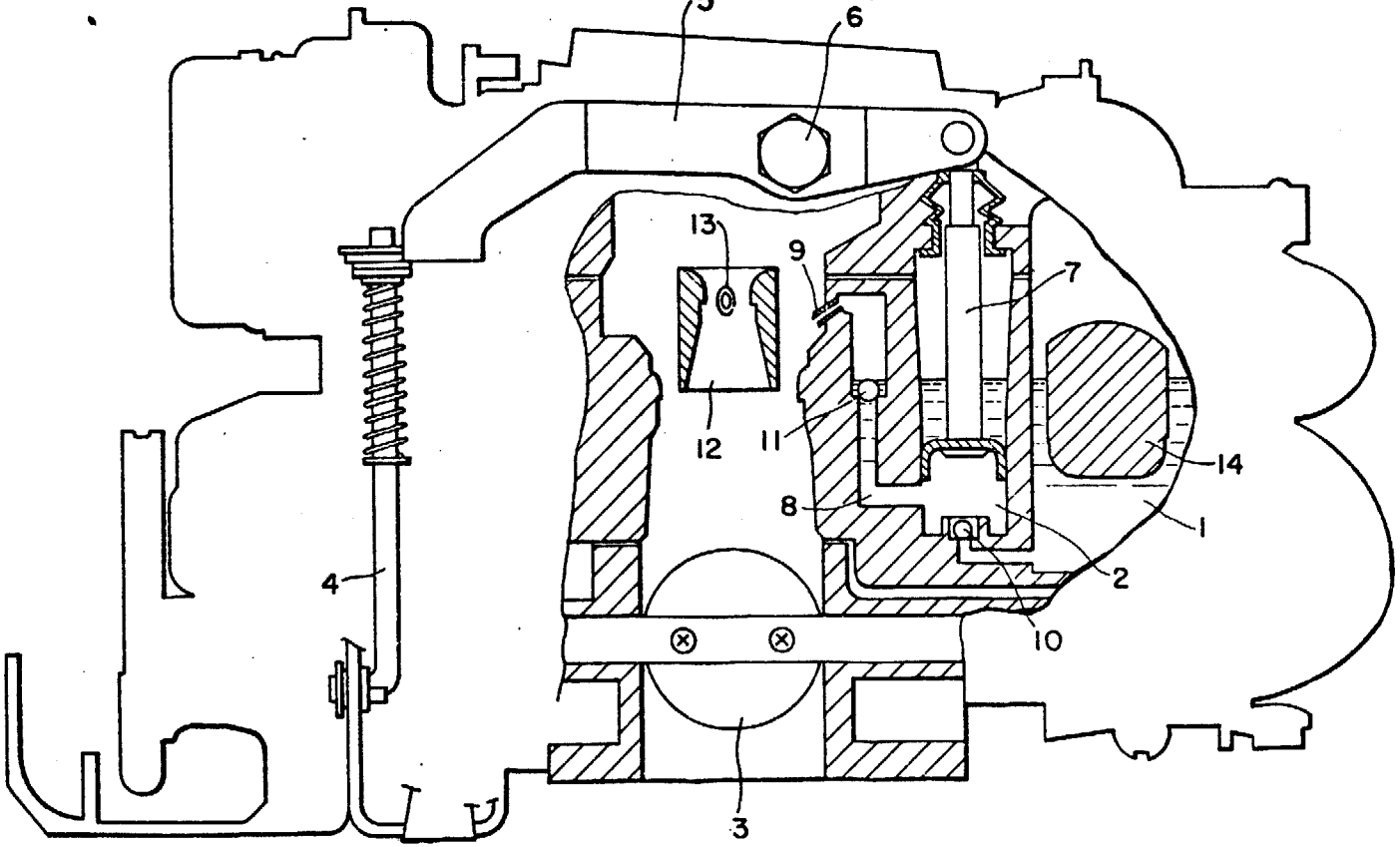
FIG. 1 (PRIOR ART)
Figure 2:
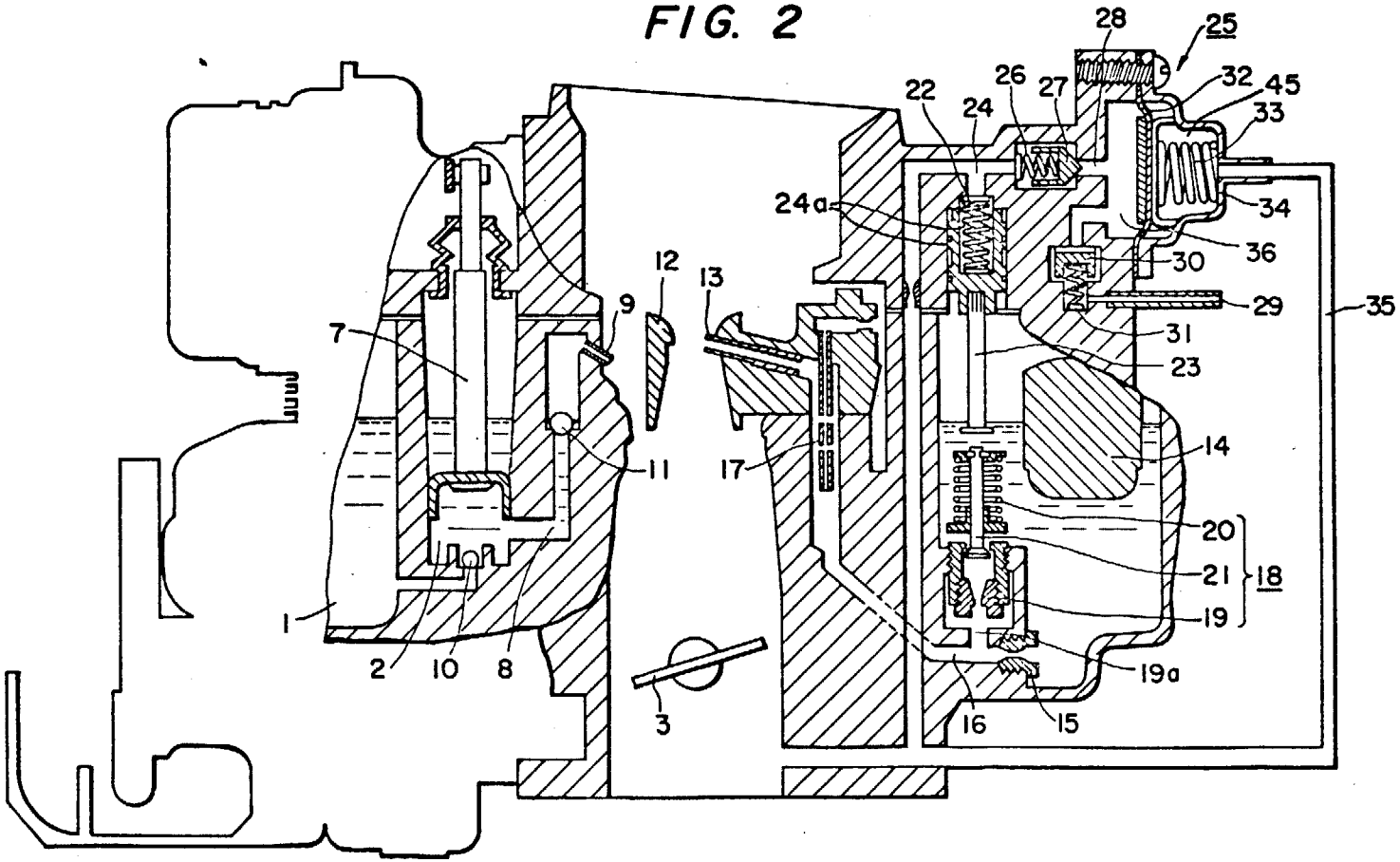
Figure 5:
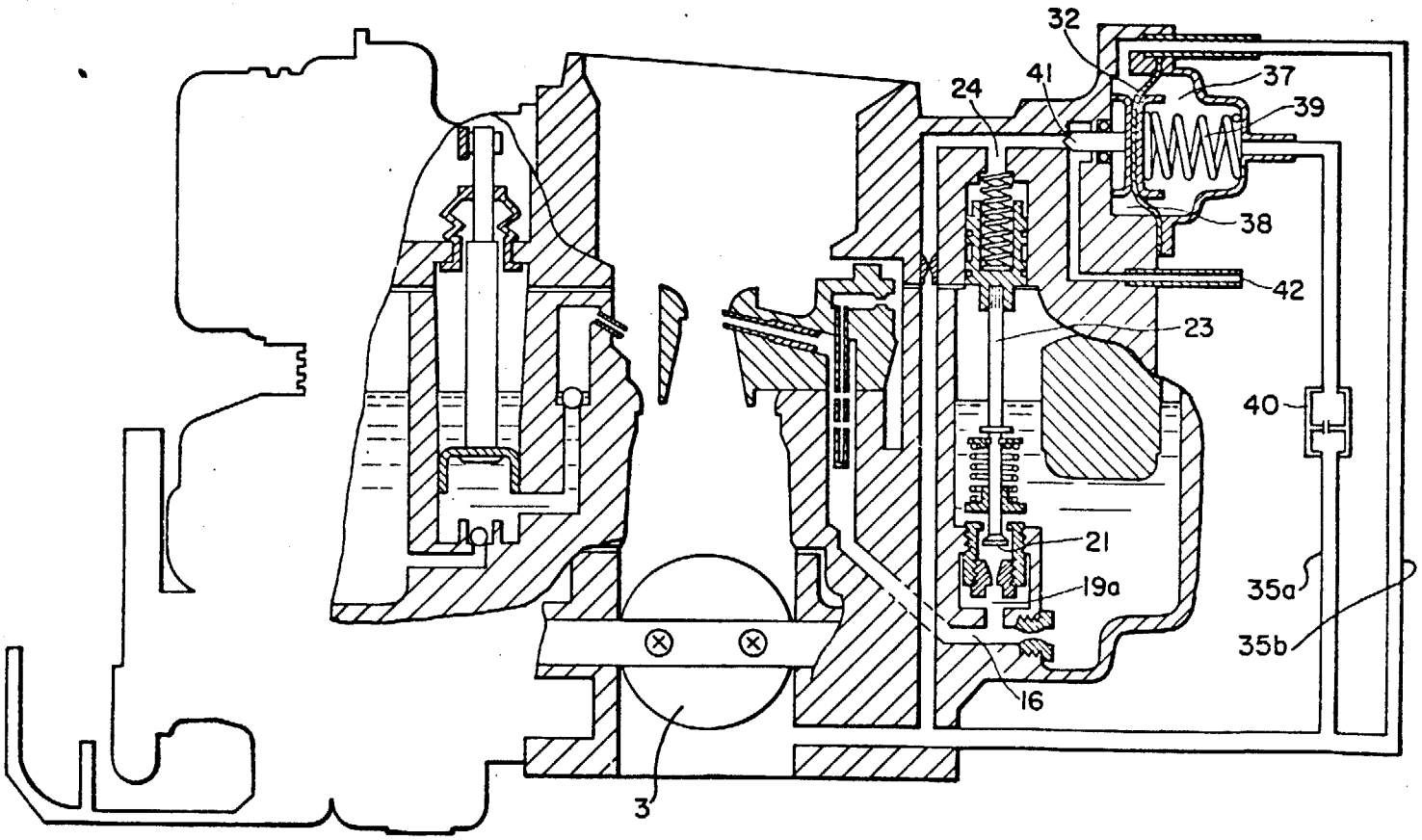

FIG. 5 shows another embodiment of this invention. The negative pressure chambers 37, 38 partitioned by the diaphragm 32 are applied with negative suction pressures through the negative suction pressure passages 35*a*, 35*b*, respectively, with a spring 39 disposed in the chamber 37 and with a restriction 40 for delaying the transmission of negative pressure provided in the passage 35*a* connected to the chamber 39. The diaphragm 32 has an open-close valve 41 secured thereto by which the negative pressure passage 24 is brought into and out of communication with the atmospheric pressure passage 42. When the engine is accelerated, the negative pressure in the suction pipe varies causing the open-close valve 41 to open to admit the atmospheric pressure into the negative pressure passage 24. As a result, the piston 23 moves downward to open the valve 21 thereby adjusting the air-fuel ratio of the mixture to a proper value, as in the preceding embodiment. In this embodiment, when the throttle valve 3 is opened by depression of the accelerator pedal for acceleration during running, the intake negative pressure is lowered and this lowered intake negative pressure is transmitted via passage 35*a*, 35*b* to the negative pressure chambers 37 and 38, respectively. The transmission of this lowered negative pressure to the negative pressure chamber 37, however, is delayed due to the action of the aforementioned restriction 40, so that the diaphragm 32 is deflected to the right thereby communicating line 24 with atmosphere via line 42. After a while, as the same negative pressure is established in the negative pressure chamber 37 as in the chamber 38, the diaphragm is reset at the illustrated position closing atmospheric communication with line 24. Thus, the rate of fuel supply is increased over a predetermined length of time during the acceleration. This time length can be adjusted as desired by varying the volume of the negative pressure chamber 37 and the flow resistance in the restriction 40.

As can be seen from the foregoing, the carburetor of this invention in which additional fuel required for acceleration is supplied from the fuel adding valve 18 together with the main fuel, has the following features: the amount of additional fuel for acceleration can be controlled by changing the size of the auxiliary jet 19; the diaphragm 32 can be actuated at a desired degree of acceleration by setting the force of spring 33 or 39 at a proper value; and the length of time and the timing of the delivery of the additional acceleration fuel can be controlled by suitably selecting the volume of the chamber 36, or providing the restriction 40 or a temperature-actuated valve in the vacuum passage 35*a*.

Thus, with this invention, an optimum air-fuel ratio can be obtained over the desired length of time at a time of acceleration because when the engine is accelerated the additional fuel is supplied to prevent the mixture from becoming lean. This ensures the smooth acceleration and contributes greatly to the reduction of noxious gas emission.

What is claimed is:

1. A carburetor having a suction pipe, comprising a main fuel passage, a fuel adding passage adapted for adding fuel and disposed in said main fuel passage, a fuel adding valve means disposed in said fuel adding passage for opening and closing the latter, said fuel adding valve means including an auxiliary jet valve and a spring means for biasing said auxiliary jet valve in a direction of closing said fuel adding passage, piston means for being biased by a biasing force in a direction for engaging said valve means, means defining a piston chamber, said piston means is disposed in said piston chamber, means comprising a negative pressure passage communicating with said suction pipe and connected to one end of said piston chamber for introducing intake negative pressure such that a force generated by said negative pressure acts in a direction against the biasing force acting on said piston means, another valve means for communicating therethrough said one end of said piston chamber with atmospheric pressure, diaphragm means for actuating said another valve means and defining a negative pressure chamber, and an intake negative pressure introduction passage communicating with said suction pipe and leading to said negative pressure chamber of said diaphragm means.

2. The carburetor as set forth in claim 1, wherein said diaphragm means includes internal means for actuating said another valve means for communicating said one end of said piston chamber with atmospheric pressure for a predetermined time.

3. The carburetor as set forth in claim 2, said internal means constitutes an atmospheric pressure chamber of said diaphragm means connected to said one end of said piston chamber via said another valve means.

4. The carburetor as set forth in claim 3, wherein said another valve means further includes an atmospheric valve means for communicating said atmospheric pressure chamber to atmosphere when said another valve means is unactuated by said diaphragm means, said another valve means for closing off said atmosphere pressure chamber from communication with said one end of said piston chamber, said atmospheric valve means for closing off said atmospheric chamber from atmosphere when said another valve means is actuated by said diaphragm means for opening said atmospheric pressure chamber to said one end of said piston chamber.

5. The carburetor as set forth in claim 4, wherein said another valve means includes a first spring means for biasing said another valve means in a direction for closing communication between said atmospheric pressure chamber and said one end of said piston chamber and a second spring means for biasing said atmospheric valve means in a direction for opening said atmospheric pressure chamber to atmosphere.

6. A carburetor having a suction pipe, comprising a main fuel passage, a fuel adding passage adapted for adding fuel and disposed in said main fuel passage, a fuel adding valve means disposed in said fuel adding passage for opening and closing the latter, said fuel adding valve means including an auxiliary jet valve and a spring means for biasing said auxiliary jet valve in a direction of closing said fuel adding passage, piston means for being biased by a biasing force in a direction for engaging said valve means, means defining a piston chamber, said piston means is disposed in said piston chamber, means comprising a negative pressure passage communicating with said suction pipe and connected to one end of said piston chamber for introducing intake negative pressure such that a force generated by said negative pressure acts against the biasing force acting on said piston means, diaphragm means for operatively actuating said valve means and defining a negative pressure chamber, an intake negative pressure introduction passage communicating with said suction pipe and leading to said negative pressure chamber of said diaphragm means, control means disposed in said intake negative pressure introduction passage for controlling an operation timing of said valve means.

7. The carburetor as set forth in claim 6, wherein said control means is a restriction member.

8. The carburetor as set forth in claim 6, wherein said control means is a temperature-actuated valve.

9. The carburetor as set forth in claim 6, further comprising another valve means for communicating therethrough said one end of said piston chamber with atmospheric pressure, said another valve means comprises a valve operatively connected to said diaphragm means for being actuated thereby to provide communication of said one end of said piston chamber with atmosphere when said diaphragm means is actuated.

10. The carburetor as set forth in claim 9, wherein said another valve means when unactuated for closing communication therethrough between said one end of said piston chamber and atmospheric pressure, said control means is for terminating actuation of said another valve means by said diaphragm means after a predetermined time.

11. The carburetor as set forth in claim 10, wherein said diaphragm means includes a diaphragm and a case defining said negative pressure chamber therebetween and said diaphragm defining on another side a second chamber, another intake negative pressure introduction passage communicating said second chamber with said suction pipe, a passageway communicating with the atmosphere, said another valve means is connected to said diaphragm and is for closing and opening communication of said one end of said piston chamber with the atmosphere via said passageway in response to respective positions of said diaphragm means, another spring means for biasing said diaphragm disposed in one of said chambers of said diaphragm means, said control means is disposed in one of said intake negative pressure introduction passages.

12. A carburetor having a suction pipe in a vehicle and a throttle valve disposed in the suction pipe, comprising a main fuel passage, a fuel adding passage adapted for adding fuel and disposed in said main fuel passage, a fuel adding valve means disposed in said fuel adding passage for opening and closing the latter, said fuel adding valve means including an auxiliary jet, piston means for being biased by a biasing force in a direction for operatively engaging said valve means so as to open said fuel adding passage, means defining a piston chamber, said piston means is disposed in said piston chamber, means comprising a negative pressure passage communicating with said suction pipe adjacent the throttle valve and connected to one end of said piston chamber for introducing intake negative pressure to said one end such that a force generated by said negative pressure acts in a direction against the biasing force acting on said piston means, means for responding to a negative pressure reduction in the suction pipe upon acceleration of the vehicle upon opening the throttle valve for extra reduction (as compared to said negative pressure reduction in the suction pipe) of the negative pressure at said one end of said piston chamber only for a predetermined time period such that the biasing force on said piston means counteracts the extra reduction of the negative pressure at said one end of said piston chamber and operatively engages said valve means for opening said fuel adding passage, said negative pressure when not extra reduced by said reducing means counteracting the biasing force on said piston means before the acceleration and after said time period, respectively.

13. The carburetor as set forth in claim 12, wherein said reducing means communicates atmospheric pressure to said one end of said piston chamber only during said predetermined time period.

14. The carburetor as set forth in claims 1 or 6, wherein said spring biasing force being such that said piston means does not engage said first-mentioned valve means when said one end of said piston chamber is closed from communicating with atmospheric pressure by said another valve means.

15. The carburetor as set forth in claims 1 or 6, further comprising a throttle valve disposed in said suction pipe, said main fuel passage opens into said suction pipe upstream of said throttle valve, a fuel chamber communicates with an end of said main fuel passage, said auxiliary jet valve includes a fixed hollow member forming an auxiliary jet communicating with said fuel chamber and a fuel adding valve moveably mounted inside said hollow member, said fuel adding passage communicates with said auxiliary jet and said main fuel passage, said hollow member has a portion flanged radially inwardly above said auxiliary jet, said fuel adding valve cooperatively releasably engages said portion, said fuel adding valve includes a piston extending upwardly from said portion biased upwardly by said spring means, said piston means is linearly aligned with said piston for operatively engaging an upper portion of said piston, said intake negative pressure introduction passage communicates with said suction pipe adjacent said throttle valve, said negative pressure passage is connected to said intake negative pressure introduction passage.

16. The carburetor as set forth in claims 1, 6, 3, 4, or 5, wherein said diaphragm means includes a case and a diaphragm defining said negative pressure chamber as well as means comprising a spring disposed in said case for biasing said diaphragm in a direction toward said one end of said piston chamber.

* * * * *

UNITED STATES PATENT AND TRADEMARK OFFICE

CERTIFICATE OF CORRECTION

PATENT NO. : 4,298,550

DATED : November 3, 1981

INVENTOR(S) : Kenji Hayashi

It is certified that error appears in the above—identified patent and that said Letters Patent is hereby corrected as shown below:

Figures 1, 2 and 5 should appear as shown on the attached sheets.

Signed and Sealed this

*First* Day of *June 1982*

[SEAL]

*Attest:*

GERALD J. MOSSINGHOFF

*Attesting Officer* *Commissioner of Patents and Trademarks*